US005910772A

United States Patent [19]

Hui

[11] Patent Number: 5,910,772

[45] Date of Patent: Jun. 8, 1999

[54] POOL ALARM

[76] Inventor: Joseph Hui, 140-B S. Whisman Rd., Mountain View, Calif. 94041

[21] Appl. No.: 08/908,918

[22] Filed: Aug. 8, 1997

[51] Int. Cl.[6] ..... G08B 23/00

[52] U.S. Cl. ..... 340/573.6; 335/205

[58] Field of Search ..... 340/573, 566, 340/618, 623, 625, 573.6; 335/205, 206

[56] References Cited

U.S. PATENT DOCUMENTS

| | | | |
|---|---|---|---|
| 3,803,573 | 4/1974 | Schonger | 340/565 |
| 3,849,771 | 11/1974 | Applin | 340/624 |
| 4,069,405 | 1/1978 | Fima | 340/566 X |
| 4,510,487 | 4/1985 | Wolfe et al. | 340/566 |

*Primary Examiner*—Thomas Mullen

[57] ABSTRACT

An apparatus for sounding an audible alarm when an object, such as a child or a pet, falls into a pool. An elongated housing is secured to the pool such as by fastening it to a pool ladder, with a control head on one end above the water surface and the other, sensing, head below the surface. At least one reed switch is positioned at the lower end of the housing. An elongated permanent magnet is mounted in a support body typically a buoyant body fastened to a flexible but stiff strap so that one pole of the magnet is adjacent to the reed switch. The magnet is positioned with the line through the north and south magnetic poles being approximately perpendicular to the switch. The strap is secured to an open container below the housing such that the strap and buoyant body can pivot in a single plane lying substantially parallel to the length of the reed switch. Thus, when the pool is calm the center of the magnet is adjacent to the reed switch. When a body falls into the pool, the resulting wave and compression causes the buoyant body to pivot, moving the magnet relative to the reed switch, activating the reed switch, causing the alarm to sound. A second reed switch can be arranged parallel to and offset from the first reed switch to allow the switches to be connected to the alarm in a manner permitting system sensitivity to be varied. Alternative magnet supports may be used.

9 Claims, 5 Drawing Sheets

POOL ALARM

FIELD OF THE INVENTION

This invention relates to apparatus for detecting an object falling into a pool and sounding an alarm,

BACKGROUND OF THE INVENTION

Swimming pools and other pools such as those used for raising Koi or for decoration can be very dangerous for children, dogs, adults who are disabled or under the influence of alcohol, etc. Most home or apartment pools do not have a lifeguard or anyone else in attendance at all times. A person or animal who falls into such a pool and cannot get out is in serious danger of drowning.

Because of this danger, pools are generally required to be fenced or have a sturdy cover. However, these protective devices can be bypassed or the pool can be inadvertently left unprotected.

A number of different alarms have been developed to sense an object falling into a pool and sound a loud, audible alarm at the pool site and/or in selected nearby buildings, such as a house, apartment clubhouse or manager's office, etc.

One type of pool alarm, exemplified by U.S. Pat. No. 4,775,854, to Cottrell includes a floating sensor and a contact means that closes an alarm circuit when the device is tilted by the wave created by an object falling into the pool. Unfortunately, this type of alarm can be easily triggered by wind generated waves, by the floating sensor bumping against a pool side, etc.

Another type of pool alarm, as described in U.S. Pat. No. 3,778,803 uses a submerged or surface hydrophone to detect sound created by an object falling into the pool. However, this type of alarm can be triggered by nearby loud noises, such as loud music, motorcycles, low flying aircraft, in particular helicopters, etc. Heavy rain can generate sufficient noise to trigger such an alarm system.

Other pool alarms of the sort described in U.S. Pat. No. 2,935,582 respond to pressure changes in the water. However, these often have a narrow sensitivity band between sufficient sensitivity to detect a small child or pet struggling in the water while not generating false signals in response to wind generated waves. Water displaced by a child or pet may be so small that the alarm will not be actuated. If the gain is set too high, the detector will pick up pressure changes created by surface waves generated by a strong wind.

Ultrasonic sound waves generated below the water surface have been used to detect an object falling into the water or struggling in the water by the changes in the waves received at a an ultrasonic sound receiver, as described by Dunegan et al. in U.S. Pat. No. 4,747,085. While ultrasonic detection systems are very effective in detecting intruders in rooms or buildings where nothing should be moving, these systems are less effective in pools, where the surface is constantly moving in response to wind and the surface waves caused by the wind can trigger the alarm. Also, these systems are expensive and draw considerable power so are not practical for a battery powered system.

Many of these prior alarm systems are mechanically and/or electrically complex and require complex mounting systems, so that random failures and wearing out may occur making the alarm inoperative without those depending on the alarm being aware of the failure. Excessive false alarms will lead to the system being turned off much of the time, often at the most dangerous times such as at night.

Thus, there is a continuing need for a simple, easily mounted, reliable pool alarm that can detect a small object such as toddler or pet falling into the pool and will not produce false alarms except under the most unusual conditions.

SUMMARY OF THE INVENTION

The above-noted problems, and others, are overcome in accordance with this invention, basically, by an apparatus including a housing adapted to be mounted adjacent to a pool surface with at least a first end extending below the water surface, a magnetably actuatable reed switch mounted in the housing near the first end, an elongated permanent magnet having north and south poles at opposite ends, installed in the housing first end adjacent to the reed switch, the magnet being mounted with one of the north and south poles adjacent to the reed switch and the other pole extending away from the reed switch. The magnet is movable back and forth past the reed switch in response to water movement caused by a body falling into the pool.

In one embodiment, the magnet is mounted on a pivotable arm with a buoyant member at the upper end that will be moved by water disturbances past the reed switch. In another embodiment, an arm extends to both sides of a pivot point, with the magnet secured to one end of the arm above the pivot point adjacent to the reed switch and a weight on the arm below the pivot point that will similarly cause the pivotable arm to move in response to a body falling into the pool. In a third embodiment, an open ended transverse tube or the like is provided running adjacent to the reed switch with a magnet slidable in the tube in response to water entering or leaving the tube ends.

The magnet is moved by any of these embodiments to move uppermost pole past the reed switch. The magnet is generally maintained by the arm in a vertical position, approximately perpendicular to the reed switch with either the north or south pole moving adjacent to the reed switch. When a wave or water compression resulting from a heavy object such as a child or pet falling in the pool reaches the housing, the upper buoyant member, or the lower weight or the magnet in the tube, depending upon the magnet mounting embodiment and actuate the reed switch to set off an alarm.

While it is necessary for the buoyant member or the weight or the sliding magnet to extend below the water surface, if desired the switch assembly could be above the water surface. The first end of the housing could extend below the surface any suitable distance, typically from about 6 to 18 inches. By extending the first end well below the surface, typically at least 6 inches, natural evaporation will not quickly lower the surface to the point where the buoyant member is no longer emersed.

The upper end of the housing, extending out of the water, contains conventional system sensitivity adjustment means, an alarm, battery to power the alarm, on and off switch, etc. If desired a wireless transmitter may be included to send an alarm actuation signal to a remote alarm site.

In order to provide effective sensitivity adjustment for waves caused by varying wind speeds and the like, it is preferred that two offset reed switches be used. The switches are arranged adjacent to the magnet pole so as to be normally closed. When either switch opens, the alarm will be actuated. As detailed below, the hysteresis effect inherent in a reed switch can be a significant problem when magnetically actuating the switch with the magnet in the usual position with the poles parallel to the switch. This problem is overcome by this invention through arrangements for varying response of the switch system depending upon the manner in which the switches are interconnected.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
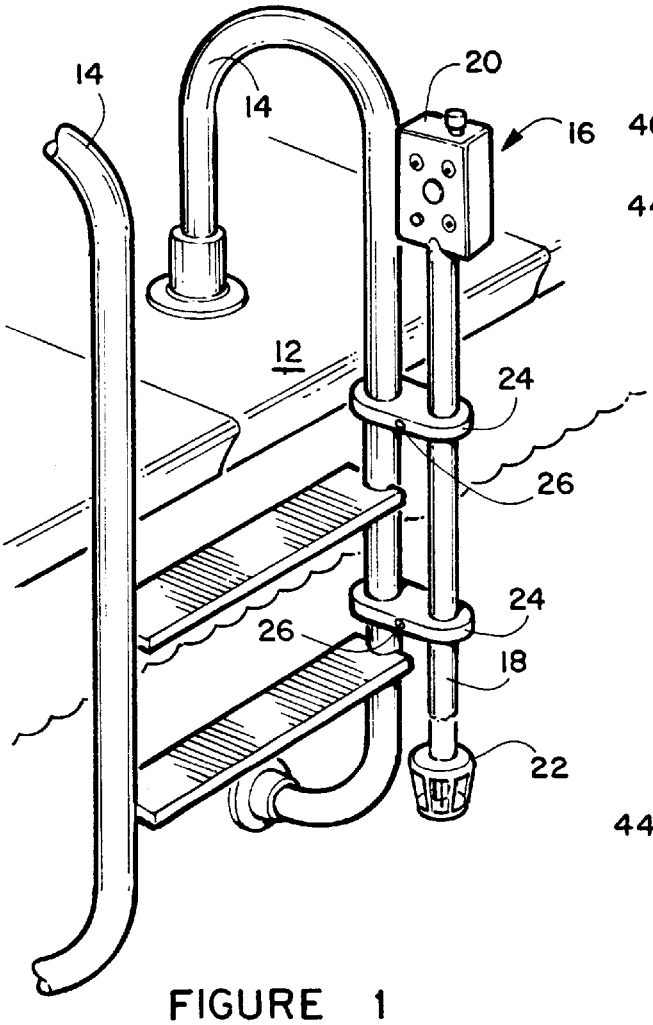
FIG. 1 is a perspective view of the alarm of this apparatus mounted on a swimming pool ladder.

Referring to FIG. 1, there is seen a portion of a conventional swimming pool, including water 10, coping 12 and ladder 14. A self-contained alarm apparatus 16 includes a generally tubular body 18, a head 20 that houses the alarms and alarm control circuitry and an enclosure 22 for the alarm actuation device.

Body 18 is secured to the ladder 14 by a pair of clips 24. Each clip is in two vertically separated halves, with the separation line running through the centers of the ladder tube and tubular body 18. A bolt 26 extends centrally across each clip to tighten the clips to the tubes. While this preferred mounting arrangement is preferred for simplicity and reliability, any other suitable mounting means may be used, if desired.

Figure 2:
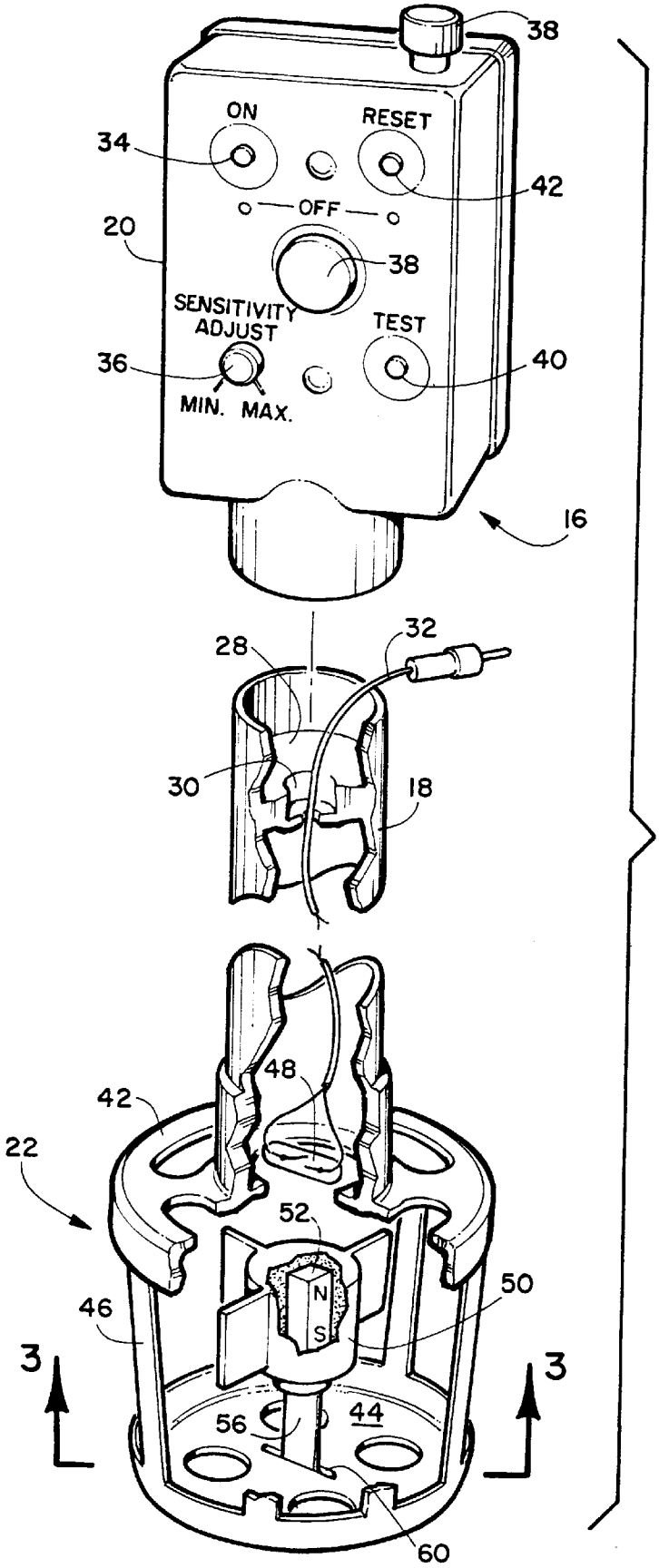
FIG. 2 is a perspective view, partially cut away, of the alarm apparatus.

FIG. 2 shows details of the structure of alarm apparatus 16. Tubular body 18 is preferably formed from a tube of plastic or other corrosion resistant material. Typically, tubular body 18 has one or more reinforcing rings 28 molded or bonded internally, with holes 30 for passage of wire 32 extending between the detection device in enclosure 22 and the alarm circuitry in head 20.

The proximal end of tubular body 18 is fastened to head 20, typically by adhesive bonding or co-molding, where both are formed from the same plastic, as is preferred. The alarm sounder, battery and various controls are contained within head 20. Typically, an on and off switch 34, an alarm sensitivity control 36, an alarm test button 40 and a reset button 42 are provided. Elements 38 are merely decorative.

A reed switch 48 is mounted within the distal end of tubular body 18 transverse to the body centerline. Reed switch 48 may be either normally open or normally closed, as desired, so long it is oriented so that movement of a magnet past the switch will cause it to change state.

The reed switch may be either a normally closed or a normally open switch. With a normally closed reed switch, the magnet will open the switch when the magnet is closely adjacent to the switch housing and the switch will automatically close to actuate the apparatus when the housing is moved away from the magnet. In some cases, a normally open switch will be preferred. In that case, a weak permanent magnet is positioned in the housing. The weak magnet has just enough power to close the switch. The magnet on the frame will be much stronger and positioned to overcome the weak magnet and open the reed switch when located in close proximity to the housing. The choice of reed switch type will generally depend on component and manufacturing costs.

An open enclosure 22 is mounted at the distal end of tubular body 18, such as by co-molding or adhesive bonding. Enclosure 22 includes perforated upper and lower surfaces 42 and 44, respectively and a plurality of side bars 46.

A buoyant member 50, preferably formed from closed cell plastic foam or a closed container, is positioned within enclosure 22 with the upper surface adjacent to reed switch 48. A permanent magnet 52 is embedded in the upper surface of buoyant member 50 with one pole ( the north pole as shown)extending toward the assembly of reed switches 48 and 49.

Figure 3:
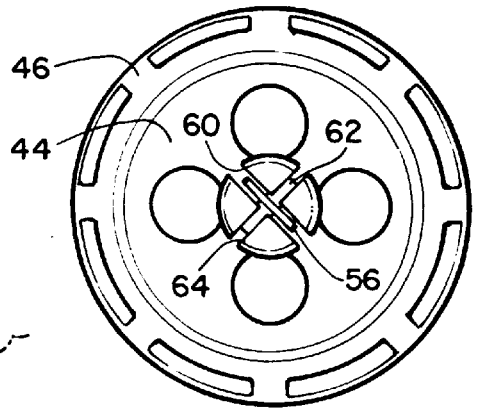
FIG. 3 is a view looking upwardly at the lower end of the apparatus, taken on line 3—3 in FIG. 2.
Figure 4:
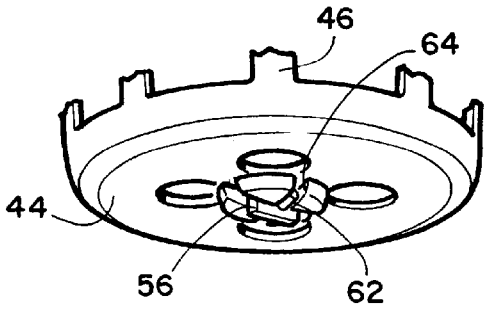
FIG. 4 is a perspective view of the underside of apparatus.

A stiff, flat, strap 56 extends through a corresponding slot 60 in a raised central area 58 on bottom surface 44. A short pin 62 passes transversely though a hole (not seen) in the lower end of strap 56. As seen in FIGS. 3 and 4, there is a linear recess 64 into which pin 62 is snapped to hold the end of strap 56 in place while allowing the strap to pivot about pin 62 in the plane of the strap. Since the north pole of magnet 52 extends upwardly and lies in the plane of strap 56, as waves impact buoyant member 50 that member will pivot back and forth slightly, moving the magnet linearly past reed switches 48 and 49. The effect produced by movement of magnet 52 will always be consistent for a given degree of water disturbance.

Normally closed reed switches 48 and 49 will be maintained in the closed position when adjacent to the center of magnet 52 while the water surface is still or has small waves. A body falling into the water will cause large waves and pressure changes so as to move the north and/or south magnet pole past reed switch 48, opening and closing the switches, actuating the no alarm.

Figure 5:
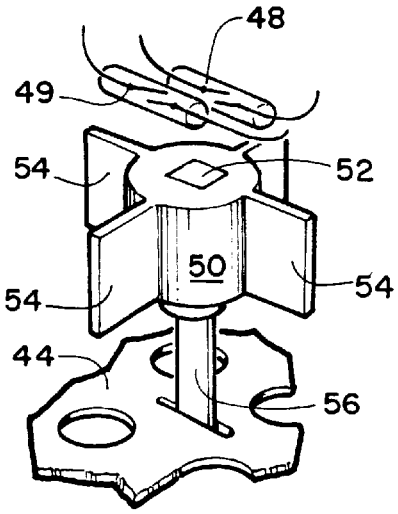
FIG. 5 is a detail view of a double switch embodiment.

The pivoting strap 56 carrying magnet 52 could be offset slightly from the center of the switch 49, say 0.3 inch with strap 56 vertical and at rest as seen in FIG. 5. Then, when the magnet 52 swings on strap 56, a swing of 0.6 inch in one direction (and, of course, 1.2 inch in the opposite direction) would open switch 49 and actuate the alarm. Thus, offsetting the magnet pole "at rest" position increases system sensitivity. This does not allow sensitivity to be varied.

However, by placing two reed switches 48 and 49 adjacent and parallel but offset (preferably 0.2 to 0.5 inch) with the magnet pole at rest aligned with the center of switch 48 and offset from the center of switch 49, and providing means for selecting different combinations of switches, four different levels of sensitivity can be provided.

Figure 6:
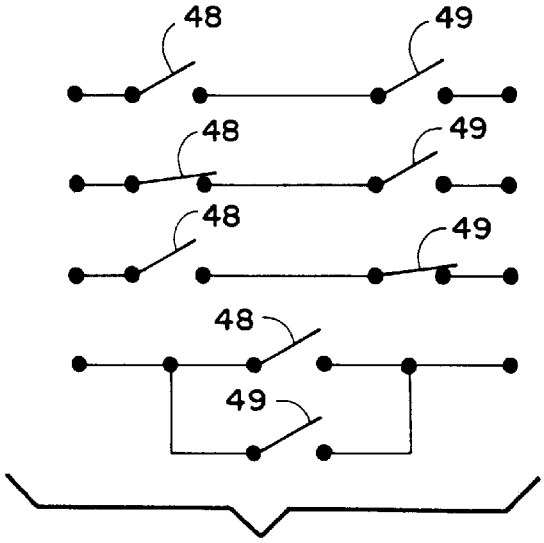
FIG. 6 is a schematic view of the various alternative switch arrangements.

FIG. 6 is a schematic representation of the circuits for operating the alarm and control the various adjustments, such as sensitivity, as discussed above. With both switches 48 and 49 in series, highest sensitivity will be provided, since opening of either switch will actuate the alarm. Second highest sensitivity will be provided when only switch 48 is connected to actuate the alarm circuit. Medium sensitivity will be provided when only the centered switch 49 is connected to actuate the alarm. Lowest sensitivity will result from wiring both switches 48 and 49 in parallel, so that both switches would have to be opened to trigger an alarm. A simple multi contact rotary switch can be used to select which of these arrangements is used under particular wind conditions.

If buoyant body 50 were, instead of using stiff band 46, simply connected to the bottom 44 of container 22 by a string or the like, the body would be free to move in any direction and twist, so that the effect of magnet 52 on reed switches 48 and 49 would vary significantly even without significant wave action, producing many false alarms.

A plurality, typically four, paddles 54 extend outwardly from sides of buoyant member 50. These paddles will increase the projecting area to improve wave motion influence on buoyant member 50. Thus, paddles 54 increase system sensitivity.

Figure 7:
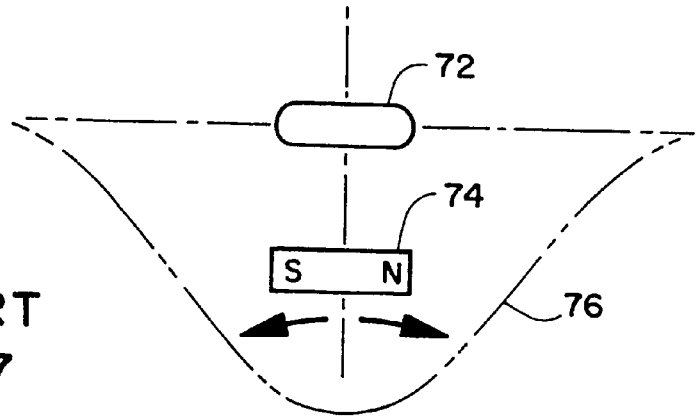
PRIOR ART FIGURE 7
FIG. 7 is a schematic representation of a prior art switch and magnet arrangement.
Figure 8:
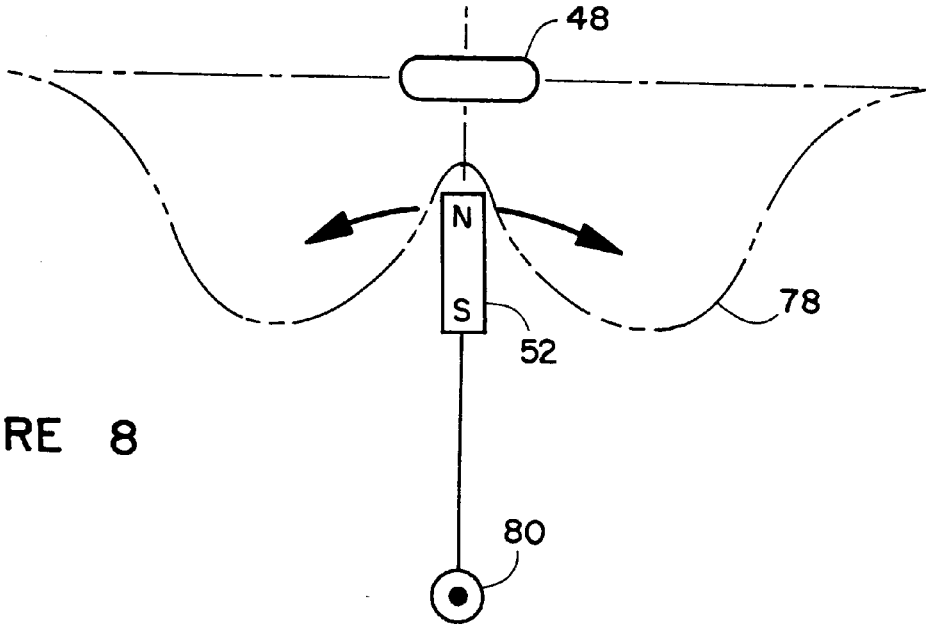
FIG. 8 is a schematic representation of an arrangement of magnet and first switch according to this invention.
Figure 9:
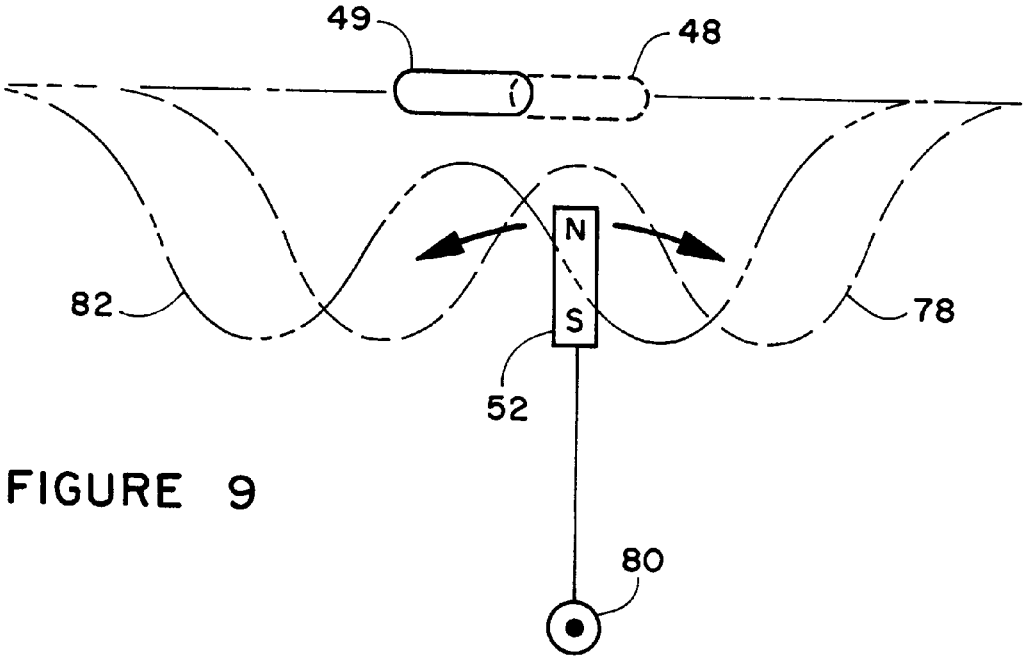
FIG. 9 is a schematic representation of an arrangement of magnet and two offset switches according to this invention.

FIGS. 7–9 illustrate the manner in which sensitivity of the system is improved by the use of the pair of reed switches 48 and 49 as shown in FIG. 5.

In the prior art, reed switches such as switch 72 shown in FIG. 7 used an actuating magnet 74 having a north-south axis parallel to the axis of reed switch 72. The area within curve 76 is the operating range. Within that area, reed switch 72 will be closed. When the magnet is out of that area, reed switch 72 will be open. Due to the inherent hysteresis effect, the area within curve 76 will be effectively slightly larger when magnet 74 is moving out of the area than when moving into the area. As is apparent, the switch will not be sensitive to small magnet movements and sensitivity is not adjustable.

With the magnet 52 oriented perpendicular to the reed switch 48 as seen in FIG. 8, as provided in this invention, the operating range will have the shape of curve 78. The system will have very high sensitivity, since magnet 52 need swing only slightly about pivot 80 to cross into or out of the area within curve 78. In some cases, this high sensitivity will be desired; in other cases a lower sensitivity will be preferred.

FIG. 9 schematically illustrates the use of a second, offset, reed switch 49, arranged as shown in FIG. 5. First reed switch 48, shown in broken lines, is still centered above pivot point and still has the operating curve 78 shown in broken lines. Offset reed switch 49 has the operating curve 82. When only switch 49 is in the circuit (per FIG. 6) the system sensitivity will be lower since magnet 52 will need to swing a greater distance to cross curve and cause switch 49 to change state. Switches 48 and 49 can be wired in any of the variations shown in FIG. 6 to vary sensitivity as discussed above.

Figure 10:
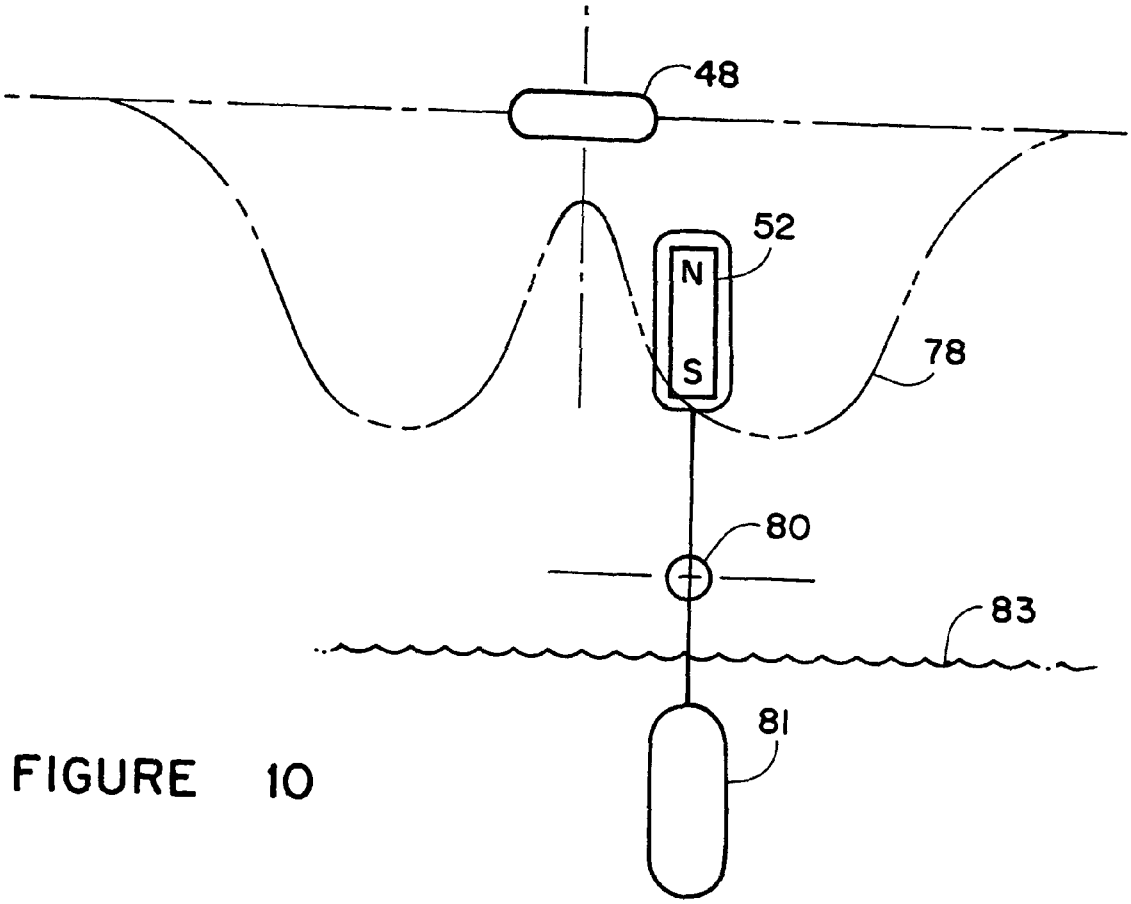
FIG. 10 is a schematic representation of an arrangement with a pivot point central to an arm with magnet and weight at the arm ends.

FIG. 10 schematically illustrates another magnet mounting arrangement. Here, magnet 52 without the buoyant member described above is mounted at one end of an arm having a central pivot point 80. A weight 81 is mounted at the other end. If desired, the housing and other components may be positioned above the water line 83, with only weight 81 extending below the water line. Of course, the assembly shown in FIG. 10 could extend well below water line 83, if desired. Water disturbances due to a body falling into the pool will move weight 81 in the same manner as the buoyant member housing the magnet in the embodiment described above.

Figure 11:
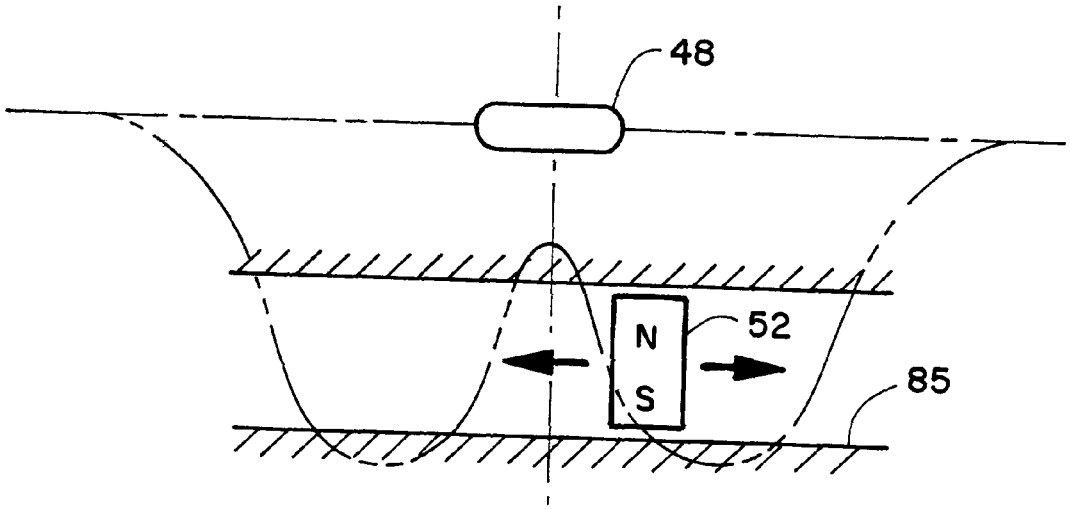
FIG. 11 is a schematic representation of an arrangement in which a magnet is slidable past a reed switch.

Another embodiment of the magnet moving arrangement is schematically illustrated in FIG. 11. Here an open-ended tube 85 of non-magnetic material is arranged adjacent to reed switch 48. A magnet 52 is positioned in tube 85 so as to be easily slid back and forth in the tube in response to water entering in and leaving the tube ends. Tube 85 will preferably have a cross section other than round (e.g., a rectangular cross section tube 85 carrying a corresponding rectangular magnet 52) so as to maintain the north pole of magnet 52 upright and adjacent to reed switch 48.

Figure 12:
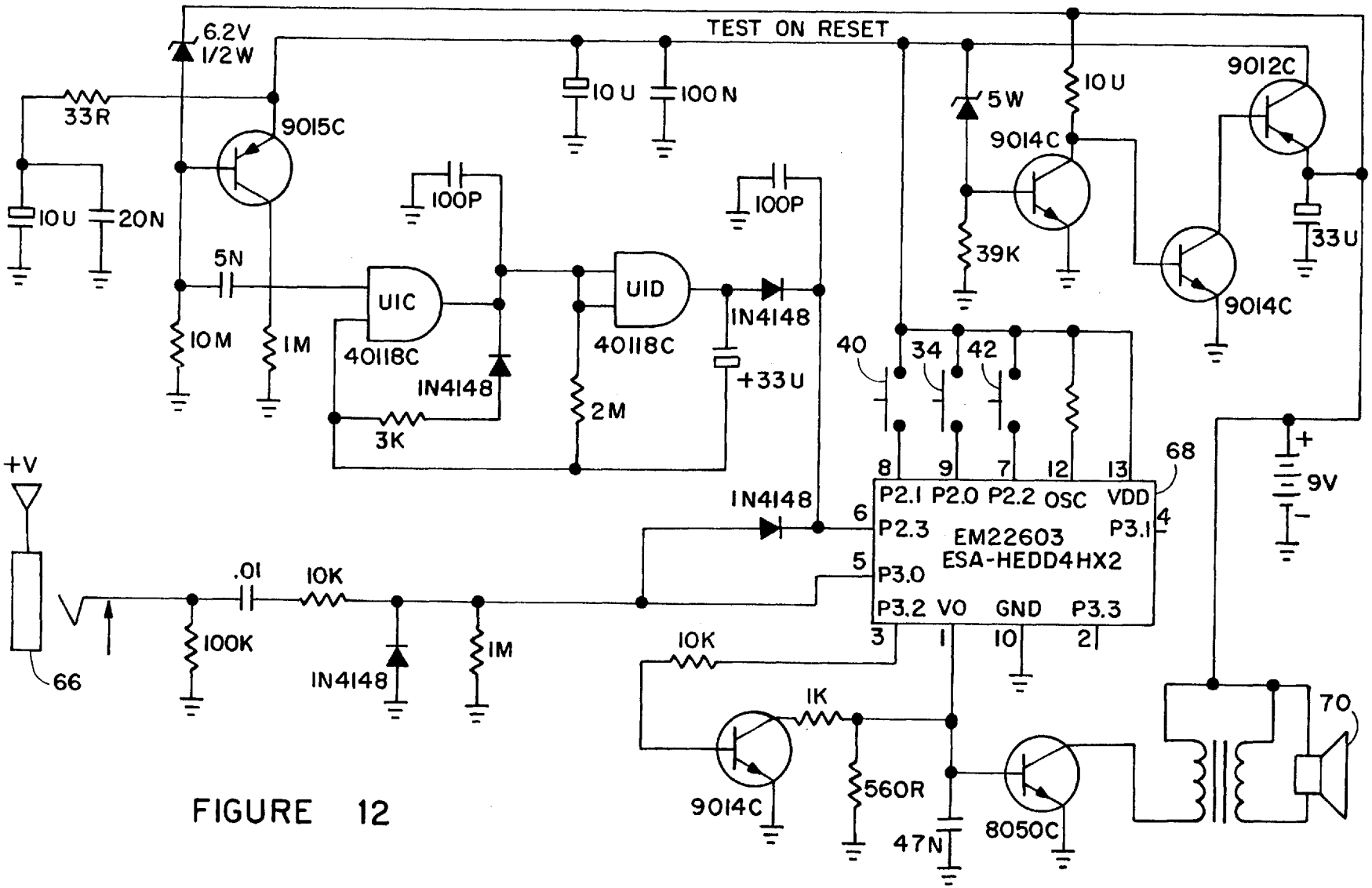
FIG. 12 is a schematic circuit diagram for the alarm.

FIG. 12 provides an overall schematic circuit diagram for the operation of the alarm system. In the embodiment shown, a single reed switch is provided. Where sensitivity adjustment is desired, a conventional rotary switch will be provided to vary the reed switch connections as seen in FIG. 6.

The circuit of FIG. 12 is formed in a conventional manner on a printed circuit board (not shown) within head 20 from conventional components. The circuit is connected through jack 66 and wire 32 to reed switch 48 as seen in FIG. 2. The system is controlled by central processing unit 68, which is programmed in a conventional manner. The CPU may contain a conventional speech it synthesizer integrated circuit if it is desired that alarm speaker 70 provide a speech alarm rather than a simple bell, siren, etc. type alarm sound. If desired, the system can send a signal to a remote alarm, using conventional wireless signal transmitting systems.

On-off switch 34, test switch 40 and reset switch 42 regulate operation. Where a single reed switch 52 is used, sensitivity control 36 may be omitted or sensitivity may be controlled electronically by CPU 68. In the embodiment using two offset reed switches 48 and 49, a simple rotary switch (not shown) will control sensitivity by selecting the desired circuit arrangement as shown in FIG. 6.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A pool alarm apparatus, which comprises:

switch support means for supporting at least one reed switch;

magnet support means for supporting an elongated permanent magnet adjacent to said reed switch and below a pool water surface;

said permanent magnet having north and south pole ends and arranged with a line between said north and south pole ends approximately perpendicular to said reed switch;

said magnet support means mounted for movement relative to said reed switch along a plane in which said elongated permanent magnet lies;

alarm means enabled by actuation of said reed switch by movement of said elongated permanent magnet relative thereto; and said support means comprising a buoyant member having proximal and distal ends, an open enclosure surrounding said buoyant member and having a bottom, a slot in said bottom, a strap having a proximal end secured to said buoyant member distal end and a distal end extending through said slot, means connected to said strap distal end for allowing pivotal movement of said strap and buoyant member in a single plane and said magnet being embedded in said buoyant member with one pole adjacent said buoyant member proximal end.

2. The apparatus according to claim 1 further including at least one outwardly extending paddle on said buoyant member intermediate said buoyant member distal and proximal ends.

3. The apparatus according to claim 1 wherein said magnet support means comprises an arm having a central pivot means, said magnet mounted on a first end of said arm and a weight mounted on a second end of said arm so that said magnet is normally maintained generally adjacent to said reed switch with the line between magnet north and south poles approximately perpendicular to a centerline through said reed switch.

4. The apparatus according to claim 1 wherein said magnet support means comprises an open ended tube arranged adjacent and generally parallel to said reed switch and said magnet is slidably contained within said tube with the line between magnet north and south poles approximately perpendicular to a centerline through said reed switch.

5. A pool alarm apparatus, which comprises:

an elongated housing having proximal and distal ends;

means for mounting said housing in a pool containing a liquid with said distal end below a liquid surface;

at least one reed switch within said distal end of said housing;

audible alarm means for sounding when said reed switch is magnetically actuated;

a support member adjacent to said distal end;

an elongated permanent magnet having north and south pole ends, supported by said support member;

a line running through said north and south pole ends lying approximately perpendicular to a centerline of said switch;

said support member including means for allowing said magnet to move generally lengthwise of said reed switch; and said support means further comprising a buoyant member having proximal and distal ends, an open enclosure surrounding said buoyant member and having a bottom, a slot in said bottom, a strap having a proximal end secured to said buoyant member distal end and a distal end extending through said slot, means connected to said strap distal end for allowing pivotal movement of said strap and buoyant member in a single plane which is parallel to the length of said reed switch and said magnet is secured in said buoyant member with one pole adjacent said buoyant member proximal end;

whereby an object dropping into said pool will cause movement of said liquid causing movement of said support member to move said permanent magnet relative to said reed switch, actuating said reed switch and sounding said alarm.

6. The apparatus according to claim 5 wherein said means for allowing pivotal movement of said strap comprises a pin secured to said bottom and extending through said strap along a line substantially perpendicular to said strap.

7. The apparatus according to claim 5 further including at least one outwardly extending paddle on said buoyant member intermediate said buoyant member distal and proximal ends, said paddle extending generally parallel to a line extending between buoyant member distal and proximal ends.

8. The apparatus according to claim 5 wherein said support member comprises an arm having a central pivot means, said magnet mounted on a first end of said arm and a weight mounted on a second end of said arm so that said magnet is normally maintained generally adjacent to said reed switch with the line between magnet north and south poles approximately perpendicular to a centerline through said reed switch.

9. The apparatus according to claim 5 wherein said support member comprises an open ended tube arranged adjacent and generally parallel to said reed switch and said magnet is slidably contained within said tube with the line between magnet north and south poles approximately perpendicular to a centerline through said reed switch.

* * * * *